US005990778A

United States Patent [19]

Strümpler et al.

[11] Patent Number: 5,990,778

[45] Date of Patent: Nov. 23, 1999

[54] CURRENT-LIMITING RESISTOR HAVING PTC BEHAVIOR

[75] Inventors: Ralf Strümpler, Gebenstorf, Switzerland; Jan H. W. Kuhlefelt, Beijing, China

[73] Assignee: ABB Research Ltd., Zurich, Switzerland

[21] Appl. No.: 09/098,983

[22] Filed: Jun. 17, 1998

[30] Foreign Application Priority Data

Jun. 25, 1997 [DE] Germany ..... 197 27 009

[51] Int. Cl.[6] ..... H01C 7/10

[52] U.S. Cl. ..... 338/20; 338/48; 338/22 R; 338/101; 338/115; 338/21; 338/260; 338/319; 361/117; 361/127

[58] Field of Search ..... 338/20, 21, 22 R, 338/22 SD, 48, 99, 101, 115, 204, 205, 260, 319; 361/106, 117, 118, 126, 127

[56] References Cited

U.S. PATENT DOCUMENTS

| | | | |
|---|---|---|---|
| 745,077 | 11/1903 | Sherlock | 338/260 |
| 946,542 | 1/1910 | Garton | 338/204 |
| 1,734,235 | 11/1929 | Slepian | 338/21 |
| 2,870,307 | 1/1959 | Milliken et al. | 338/21 |
| 2,891,194 | 6/1959 | McStrack et al. | 361/128 |
| 3,096,496 | 7/1963 | Burrage | 338/21 |
| 3,328,631 | 6/1967 | Greber | 361/127 |
| 4,451,815 | 5/1984 | Sakshaug et al. | 338/21 |
| 4,686,603 | 8/1987 | Mosele | 361/127 |
| 5,313,184 | 5/1994 | Greuter et al. . | |
| 5,379,022 | 1/1995 | Bacon et al. . | |

FOREIGN PATENT DOCUMENTS

| | | |
|---|---|---|
| 2934832 | 3/1980 | Germany . |
| 3231066A1 | 2/1984 | Germany . |
| 4142523A1 | 6/1993 | Germany . |

*Primary Examiner*—Michael L. Gellner
*Assistant Examiner*—Karl Easthom
*Attorney, Agent, or Firm*—Burns, Doane, Swecker & Mathis, L.L.P.

[57] ABSTRACT

The current-limiting resistor has two connection electrodes (1, 2) which are arranged parallel to one another, a resistance body (3) which has PTC behavior and with which large-area contact is made by the connection electrodes (1, 2) and at least one varistor (4) which is in electrically conductive contact with the resistance body (3). The varistor (4) is of pillar-shaped design and has at least two first portions (4*a*) routed predominantly perpendicularly to the varistor axis and, arranged between said portions, a second portion (4*b*) having a reduced cross section compared with each of the first portions (4*a*). The material of the resistance body (3) fills an interspace (6), which is formed by the at least two first portions (4*a*) and the second portion (4*b*), and encloses the outwardly pointing edges (4*c*) of the at least two portions.

This resistor can be operated at high voltages, for example 5 or 10 kV, and advantageously has a single resistance body 3 and a single varistor. This obviates metal electrodes serving to make electrical contact with subelements.

8 Claims, 2 Drawing Sheets

CURRENT-LIMITING RESISTOR HAVING PTC BEHAVIOR

This application claims priority under 35 U.S.C. §§119 and/or 365 to Ser. No. 197 27 009.3 filed in Germany on Jun. 25, 1997; the entire content of which is hereby incorporated by reference.

BACKGROUND OF THE INVENTION

1. Field of the Invention

The invention is based on an electrical resistor according to the preamble of patent claim 1. A resistor of this type can advantageously be used to limit a short-circuit current or overcurrent flowing in a load circuit. A switch arranged in series with the resistor in the load circuit then interrupts the limited current. This switch can therefore be designed for a small breaking power compared with the short-circuit power.

2. Discussion of Background

A current-limiting resistor of the aforementioned type is described, for example, in U.S. Pat. No. 5,313,184 A. Such a resistor contains two connection electrodes between which, connected in parallel with one another, a resistance body having PTC behavior and a varistor are arranged. The resistance body and the varistor make contact with one another via the entire insulation clearance between the two connection electrodes. This avoids local overvoltages in the resistance body and hence impermissibly high local thermal loading of the resistance body.

In order to increase the dielectric strength of this resistor, a plurality of resistors can be connected in series. Such an arrangement is relatively complicated since metal electrodes are arranged both between the individual resistance bodies and between the individual varistors. In the normal operating state of the resistor, the current is conducted through a series circuit of a plurality of resistance bodies having PTC behavior, between each of which bodies a metal electrode is arranged. The contact resistance between a metal electrode and the material of the resistance body is generally relatively high and, in the case of a typical resistor for current-limiting tasks, having a total resistance of approximately 50 mΩ, contributes just as much as the material of the resistance body to the total resistance. Furthermore, metal electrodes and the polymers which are usually used as material for the resistance body and are filled with a filler have different electrical conductivities and different thermal expansion coefficients. As a result, mechanical stresses may be produced in the interior of the resistor, which stresses may possibly impair the mechanical and electrical properties of said resistor.

SUMMARY OF THE INVENTION

Accordingly, one object of the invention, as it is specified in patent claim 1, is to provide a novel current-limiting resistor having PTC behavior which can be produced in a simple and cost-effective manner and has both a high rated current-carrying capacity and a wide voltage range as well as high operational reliability.

The resistor according to the invention contains, in a cylindrically symmetrical arrangement, a varistor of structured design or a varistor stack of structured design, in each case having small and large cross sectional areas that succeed one another alternately in the axial direction, and also a resistance body having PTC behavior. The material of the resistance body surrounds the varistor or the varistor stack whilst forming a rated current-carrying current conductor on the enclosure side, and fills interspaces, bounded by the small cross sectional areas, whilst forming an electrical contact between neighboring varistor sections having a large cross section of between neighboring varistors.

This resistor can be operated at high voltages, for example 5 or 10 kv, and advantageously has a single resistance body and a single varistor or varistor stack. This obviates metal electrodes serving to make electrical contact with subelements. Contact transitions between resistance body elements, which would significantly reduce the conductivity of the resistor before the implementation of the PTC transition, are eliminated. The current-limiting resistor according to the invention can thus be loaded by higher rated currents than a current-limiting resistor according to the prior art, given comparable dimensions.

Furthermore, both the resistance body having PTC behavior and the varistor or the varistor stack may be produced from a polymer. The resistor according to the invention can then advantageously be manufactured using a cost-effective process which is particularly suitable for mass production, preferably an injection-molding process. In this case, it is particularly advantageous that cross sections of different sizes can easily be produced in the rated current path of the resistor and resistors having different rated current-carrying capacities can thus be achieved in an extremely simple manner. Moreover, the varistor or the varistor stack is always arranged in a defined manner between ground and high-voltage potential.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
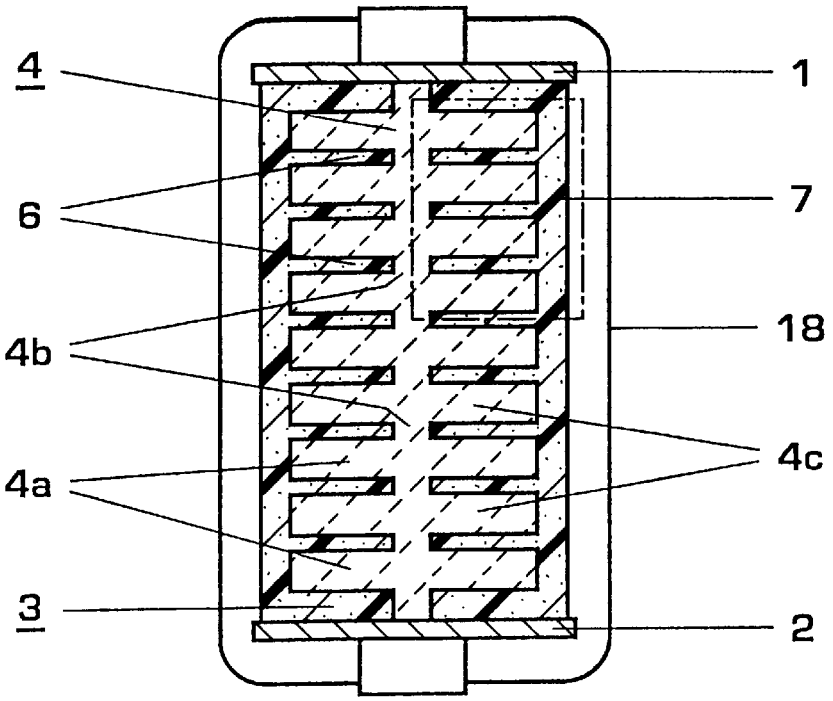
FIG. 1 shows a section in the axial direction through a first embodiment of a current-limiting resistor according to the invention with a cylindrically symmetrical varistor of pillar-shaped design.
Figure 2:
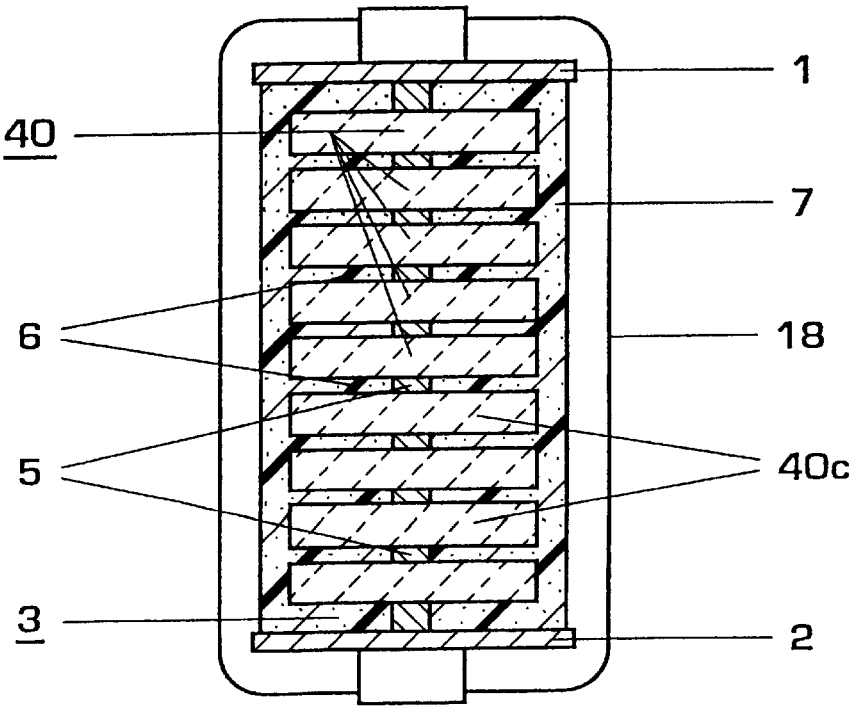
FIG. 2 shows a section in the axial direction through a second embodiment of a current-limiting resistor according to the invention having a varistor stack of cylindrically symmetrical design and containing a plurality of disk-shaped varistors which are separated from one another by spacers.

Referring now to the drawings, wherein like reference numerals designate identical or corresponding parts throughout the several views, the current-limiting resistors illustrated in FIGS. 1 and 2 each contain a resistance body 3, which is arranged between two metal connection electrodes 1, 2, aligned parallel to one another, and with which large-area contact is made, as well as a varistor 4 and, respectively, a plurality of varistors 40 which are arranged in a stack and connected in series. The connection electrode 1 is at a high-voltage potential of 10 kV, for example, whereas the connection electrode 2 is at ground potential.

The varistors 4, 40 are preferably formed from a doped ceramic based on a metal oxide, such as ZnO, for instance, or based on a titanate, such as $SrTiO_3$ or $BaTiO_3$, for instance, or based on a carbide, such as SiC, for instance. The varistor 4 provided in the embodiment according to FIG. 1 is of pillar-shaped and cylindrically symmetrical design and has nine arbitrarily shaped, preferably circular disk-shaped, portions 4*a* routed predominantly perpendicularly to the varistor axis and, between two neighboring portions 4*a* in each case a further arbitrarily shaped, preferably circular disk-shaped, portion 4*b* having a reduced cross section compared with that of each of the portions 4*a*. The nine varistors 40 provided in the embodiment according to FIG. 2 are each arbitrarily shaped, preferably circular disk-shaped, and are part of a cylindrically symmetrical stack in which the individual varistors 40 are separated from one another in the axial direction by a spacer 5 made of a preferably metallically conducting material with a reduced cross section compared with each of the at least two varistors 40. The varistors 40 may also advantageously have a centrally routed opening through which a rod is guided which holds together the varistor stack and the spacers 5, which, if appropriate, are also composed of insulating material.

The varistor 4 or the stack of varistors 40 has a breakdown voltage which lies above the rated voltage of the electrical system in which the resistor is used.

The resistance body 3 comprises a material having PTC behavior and may be formed by a polymer, in particular a thermoplastic or thermosetting polymer, which is filled with an electrically conductive filler such as, for example, high-conductivity carbon black, TiC, $TiB_2$, WC or VC. The material having PTC behavior fills annular interspaces 6 formed by in each case two of the portions 4*a* and the portion 4*b* in between, or by in each case two of the varistors 40 and one the spacers 5. It therefore serially connects neighboring varistor portions 4*a* or neighboring varistors 40. Furthermore, this material encapsulates, as an enclosure 7, the entire varistor 4 or the entire varistor stack, in particular the outwardly pointing edges 4*c* of the varistor portions 4*a* or the outwardly pointing edges 40*c* of the varistors 40. Only this part of the material having PTC behavior which is designed in the form of an enclosure implements a PTC transition above a limit temperature, during which transition one or more hot zones connected in series occur.

In general, such a hot zone has a length of approximately 2 mm and there is typically a voltage drop of 200 V across a hot zone. In order not to impair the formation of the hot zone in the region of the edge of each varistor portion 4*a* or of each varistor 40, the distance between the varistor portions 4*a* or between the varistors 40 should in each case be at least 2 mm, preferably 3–6 mm. If the varistor material has a breakdown strength of approximately 120 V/mm, then the varistor portions 4*a* or the varistors 40 will in each case have a thickness of between approximately 1 and 1.5 mm. The distance between neighboring varistor portions 4*a* or varistors 40 will then expediently be approximately 1 to 4 mm.

The varistor 4 can advantageously be formed from a varistor block of cylindrical design by means of material-moving machining, or else be produced by injection molding. The connection electrodes 1, 2 can be molded in as early as during the injection molding.

The varistor 4 produced in such a way or the varistor stack is then encapsulated with the molten material having PTC behavior, this material filling the interspaces 6 in a manner largely free from pores and forming the enclosure 7. The enclosure 7 and the connection electrodes 1, 2 are embedded in an insulating body 18, for example made of a silicone, through which two current connections (not designated) for the connection electrodes are routed.

Figure 3:
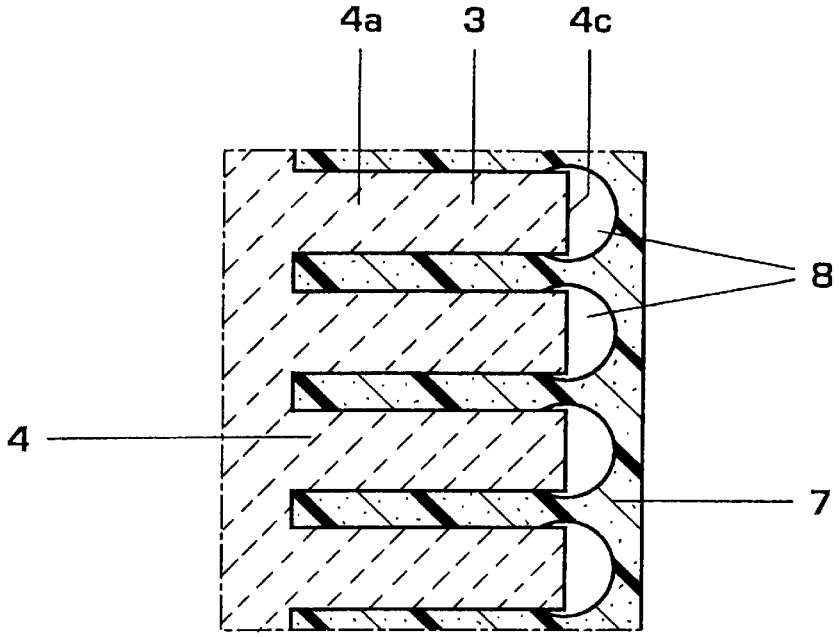
FIG. 3 shows an enlarged illustration of a part of the resistor according to FIG. 1 which is bordered by a broken line.
Figure 4:
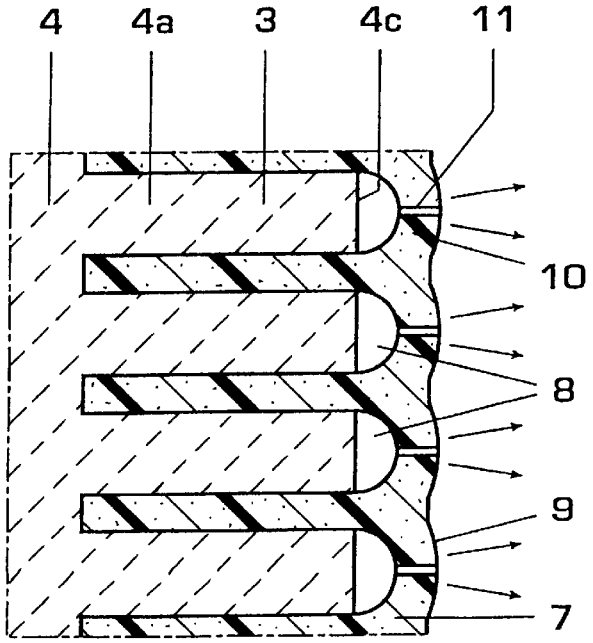
FIG. 4 shows an enlarged illustration of the part, which is modified compared with FIG. 3 and is provided in a third embodiment of the current-limiting resistor according to the invention.
Figure 5:
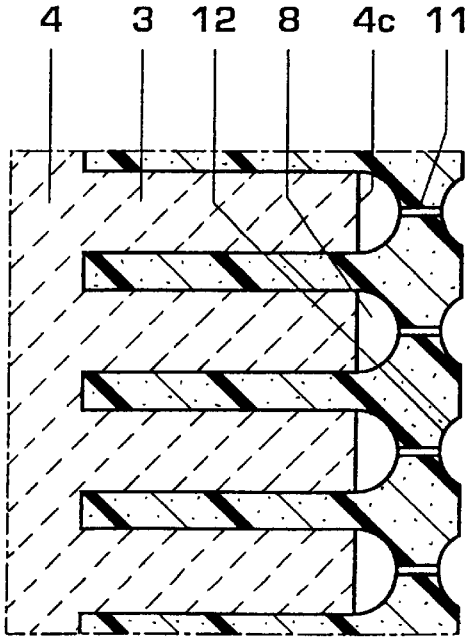
FIG. 5 shows an enlarged illustration of the part, which is modified compared with FIGS. 3 and 4 and is provided in a fourth embodiment of the current-limiting resistor according to the invention.

In order to avoid the formation of hot zones at the outer edges of the varistor portions 4*a* or of the varistors 40 in the case of such resistors, which outer edges are subjected to high dielectric loading, the edges 4*c* have, as is evident from FIGS. 3 to 5, a coating 8 made of insulating material, for example based on a polymer, such as in particular an elastomer, for instance silicone, or based on a thermoplastic, such as polyethylene, for instance. In this case, it is advantageous if the insulating material, according to FIG. 3, surrounds the edges 4*c* and the two verges thereof in a bead-shaped manner.

It is of additional advantage if—as evident from FIG. 4—the material of the resistance body is led arcuately outward in the region of at least one of the edges 4*c* and of the optionally provided coating 8, with the formation of a bead 9. A response zone 10, in which material heated during the PTC transition can expand outward and a well-localized, outwardly pointing hot zone 11 can form, is defined in the current-carrying enclosure 7 by the radius of the bead 9, which radius is located on the lateral surface of the resistance body 3 and is greater than the radius of the edge 4*c* and/or of the coating 8. As a result of this, undesirably high current densities at other locations of the enclosure 7 are avoided and the PTC transition is not mechanically suppressed.

In the embodiment according to FIG. 5, the material of the resistance body is led outward in the region of at least one of the edges, with the formation of an annular constriction 12. The formation of the hot zone 11 in a precisely localized region is defined as a result of this in a manner corresponding to the embodiment according to FIG. 4.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A current-limiting resistor, comprising:

two connection electrodes which are arranged parallel to one another;

a resistance body which has PTC behavior and which contacts the connection electrodes; and at least one varistor which is in electrically conductive contact with the resistance body; wherein the varistor is of pillar-shaped design and has at least two first portions along an axis of the varistor and, arranged between each of the at least two portions along the varistor axis, at least a second portion having a reduced width across the axis compared with each of the first portions in such a manner that between the two first portions is formed an annular interspace;

material of the resistance body fills said annular interspace and encloses at least outer edges of the at least two first portions extending radially from the axis; and the outer edges of the at least two first portions extending radially from the varistor axis are coated with insulation.

2. The resistor as claimed in claim 1, wherein the insulation surrounds the outer edges and an outer surface of the insulation forms at least one arc that is coplanar with the axis.

3. The resistor as claimed in claim 1, wherein the material of the resistance body extends radially outward from at least one of the outer edges and has at least one outer surface that is arcuately convex and annular about the varistor axis.

4. The resistor as claimed in claim 1, wherein the material of the resistance body extends radially outward from at least one of the outer edges and has at least one outer surface that is concave and annular about the varistor axis.

5. A current-limiting resistor, comprising:

two connection electrodes which are arranged parallel to one another;

a resistance body which has PTC behavior and with which contact is made by the connection electrodes; and a plurality of varistors in electrically conductive contact with the resistance body; wherein the varistors form a cylindrically symmetrical stack and are separated from one another along an axis of the stack by at least one spacer having a reduced width across the axis compared with the varistors, in such a manner that an annular interspace is formed between each adjacent pair of the varistors;

material of the resistance body fills the annular interspace and encloses at least outer edges of the varistors extending radially from the axis; and the outer edges of the varistors are coated with insulation.

6. The resistor as claimed in claim 5, wherein the insulation surrounds the outer edges and an outer surface of the insulation forms at least one arc that is coplanar with the axis.

7. The resistor as claimed in claim 5, wherein the material of the resistance body extends radially outward from at least one of the outer edges and has at least one outer surface that is arcuately convex and annular about the axis.

8. The resistor as claimed in claim 5, wherein the material of the resistance body extends radially outward from at least one of the outer edges and has at least one outer surface that is concave and annular about the axis.

* * * * *